United States Patent [19]

Kelley

[11] Patent Number: 4,658,600

[45] Date of Patent: Apr. 21, 1987

[54] ENTHALPIC EVAPORATIVE AIR CONDITIONING DEVICE WITH HEATING

[76] Inventor: Franklyn F. Kelley, 7802 N. 36th Dr., Phoenix, Ariz. 85021

[21] Appl. No.: 607,751

[22] Filed: May 7, 1984

[51] Int. Cl.[4] ..... F01N 3/02; F24F 3/14

[52] U.S. Cl. ..... 62/311; 62/235.1; 62/171; 165/60

[58] Field of Search ..... 62/304, 309, 310, 311, 62/171, 235.1; 236/49; 126/427; 165/60

[56] References Cited

U.S. PATENT DOCUMENTS

| | | | |
|---|---|---|---|
| 2,353,233 | 7/1944 | Gygax | 62/311 X |
| 3,859,818 | 1/1975 | Goettl | 62/311 |
| 4,128,124 | 12/1978 | Worthington | 126/428 X |
| 4,143,815 | 3/1979 | Meysenburg | 126/428 X |
| 4,426,853 | 1/1984 | Mitani et al. | 62/309 X |
| 4,462,539 | 7/1984 | Gilson | 236/49 |

OTHER PUBLICATIONS

Wylen, G. "Thermodynamics" Sep. 1964, pp. 224, 225.

*Primary Examiner*—Henry A. Bennet
*Attorney, Agent, or Firm*—Gregory J. Nelson

[57] ABSTRACT

An evaporative air conditioning device which in the cooling phase subjects the air to be treated to evaporative treatment. Prior to evaporative treatment the air to be treated is enthalpically heated to expand the air utilizing radiant solar energy to lower the water content per unit of volume and also the wet bulb temperature. In the preferred embodiment, a heat absorbent material is placed adjacent the inlet ducts to the unit. In the heating phase, the device is thermostatically controlled to provide solar induced heating during periods when sufficient solar energy induced heat is available.

16 Claims, 7 Drawing Figures

DATA OBTAINED - 7/17/83
POINT A - FREE AIR AMBIENT TEMPERATURE & WET BULB
POINT B - TEMPERATURE AIR WAS HEATED TO & CORRESPONDING WET BULB
LINE AB - SHIFT LINE
LINE AD - NORMAL ADIABATIC LINE TO SATURATION AIR TEMP. 75.5° F.
LINE BC - NORMAL ADIABATIC LINE TO SATURATION AIR TEMP. 66.5° F.
IMPROVEMENT TO LOWER WET BULB = 75.5° - 66.5° = 9° F

WET BULB

ENTHALPIC EVAPORATIVE AIR CONDITIONING DEVICE WITH HEATING

The present invention relates to air conditioning devices and systems and more particularly air conditioning devices which operate on the principle of evaporative cooling.

Cooling air using the evaporative cooling effect has been utilized for many years, particularly in dry climates. These conventional cooling devices generally consist of a housing, which may be square or round, in which an air moving device usually in the form of a motor-driven centrifugal blower is mounted to induce a flow of ambient air into the housing through water-wetted pads located at the sides of the housing. As the relatively dry, ambient air passes through the wetted pads, the air is cooled by the evaporative effect and the air moving device delivers the cool air to a discharge which is connected to an appropriate air distribution system. Water for cooling is supplied from a sump located in the bottom of the cooler in which the water level is maintained by a float valve. The water is pumped from the sump to the wettable pads and is generally distributed across the top of the pads and allowed to flow downwardly through the pads under the influence of gravity.

Evaporative coolers of the general type described above have found wide acceptance because of their low cost and their effectiveness at least during certain periods of the year and in certain climates. However, there are a number of problems associated with the use, operation and maintenance of such evaporative cooler devices.

The wettable pads mounted at the sides of the cooler housing or cabinet generally are manufactured from a fiberous material such as excelsior or, in some newer models, utilize a pad of treated paper having channels therein such as those sold under the name "Celdek". In any case, the pads in which the evaporation occurs deteriorate and become contaminated over a period of use. Since evaporation occurs within and on the surfaces of the pads, calcification and mineral deposits along with dirt and other foreign matter will collect in the pads increasing the resistance to air flow.

Further, the moisture laden air emerging from the cooler pads in the cabinet interior will deposit moisture on the operating surfaces. For this reason, cabinet surfaces, motor mounts, pumps and the like are all subject to corrosion.

The above problems are common to most evaporative coolers due to the inherent nature and operation of such devices. Beyond the mechanical and maintenance problems cited above, certain functional and operational problems are inherent in to coolers of this type. As discussed above, these devices draw ambient air through coolers pads and rely on the evaporation effect for cooling. The result is that air is cooled toward the wet bulb temperature which is in almost all instances lower than the ambient air temperature and then directed into the area to be cooled. Architectural design standards rate conventional evaporative cooling machines as being approximately 60 to 80 percent efficient in reaching a saturation temperature where maximum cooling is achieved. This means that when the wet bulb for a given day is 80 degrees Fahrenheit, the ambient air temperature will be lowered to within 60 to 80 percent of the wet bulb and the resulting air cooling will be above 80 degrees Fahrenheit. This saturation efficiency short fall places these cooling machines at a disadvantage particularly in conditions of hot, wet air. Such periods are common in the Southwestern United States in the months of July and August when a phenomonon called "Monsoons" occurs in which warm, moist tropical air is pushed north into the Southwestern United States. It is not uncommon during these periods to have air conditons of 110 degrees Fahrenheit dry bulb and 80 degrees Fahrenheit wet bulb. At 80 percent saturation efficiency, air treated using the evaporative effect would be cooled only to 86 degrees Fahrenheit. Obviously, this is quite uncomfortable and well in excess of the comfort zone which is generally considered to be approximately 72 to 76 degrees Fahrenheit. Accordingly, evaporative coolers are not effective during this time and users either have to endure degraded cooling or revert to move expensive devices to operate such as conventional vapor comparison cycle air conditioning systems.

Further, evaporative cooler devices are generally not used at all in winter periods in addition to being limited in the summer by ambient conditions. In view of the limited periods of usefulness of evaporative coolers, there exists a need for an improved evaporative cooler which has a longer period of operational effectiveness and which can be used for cooling even in periods of relatively hot, moist air and also can be utilized for lowering heating expenses in at least moderate winter climates.

In accordance with the present invention, a new and improved evaporative air conditioning device is disclosed which is useful both during the cooling season and during the heating season. In milder climates during the winter months, there are a substantial number of days in which the daytime temperature exceeds 68 degrees Fahrenheit. As this temperature is approached, the air above a surface exposed to solar radiation exceeds 72° F. These hours occur predominantly during the day and display an inverted bell-shape distribution curve which favors early and late winter for best solar induced heat availability. The air conditioning device of the present invention is thermostatically controlled to provide solar induced heat to an area during periods when sufficient solar heating is available and is therefore termed "enthalpic heating" since it utilizes solar heating (passive solar energy) introduced from outside the system of the invention. The device of the present invention includes a control system in which a low voltage thermostatic heat sensing switch for winter heating operation makes contact on a predetermined temperature rise to complete the low voltage thermostatic circuit in the house and allows the blower within the evaporative air conditioning unit to run when ambient warm air is present for heating in the home. In the preferred embodiment the evaporative air conditioning unit also includes a high efficiency capacitor start capacitor run AC electric motor or a permanent magnet brush or brushless DC electric motor of the orientated ferrite-type permanent magnet field for electrical power reduction.

In the enthalpic cooling phase of operation, the air conditioning unit of the present invention includes a motor-driven air moving device which is open to ambient air having a discharge connected to the area to be cooled. Air is cooled by evaporation either at conventional pads at the exterior of the housing or in specially designed evaporator ducts within the air flow path.

Water may be distributed across the conventional pads or may be supplied under pressure from a suitable source by one or more spray nozzles located in an expansion chamber area within the air flow path. The improved cooling efficiency is obtained by expanding the air prior to its entry into the unit by utilizing heat provided by radiant solar energy. In the preferred embodiment, a heat absorbent material is placed adjacent the cooler intake to heat the incoming air above the ambient free-air temperature. When the air is heated it expands thereby lowering the water content per unit of volume which results in a lower humidity level and dryer air. The expanded dryer air has a lower wet bulb temperature which results in a lower temperature of cooled air being discharged from the unit than would be possible by drawing in untreated ambient air.

The enthalpic heating of incoming air may be applied to conventional coolers of square or round design or may be used with high efficiency coolers such as is shown in my prior patent, U.S. Pat. No. 4,308,222.

The foregoing and other objects of the present invention will be more fully understood from the following description when read in conjunction with the accompanying drawings in which.

Figure 1:
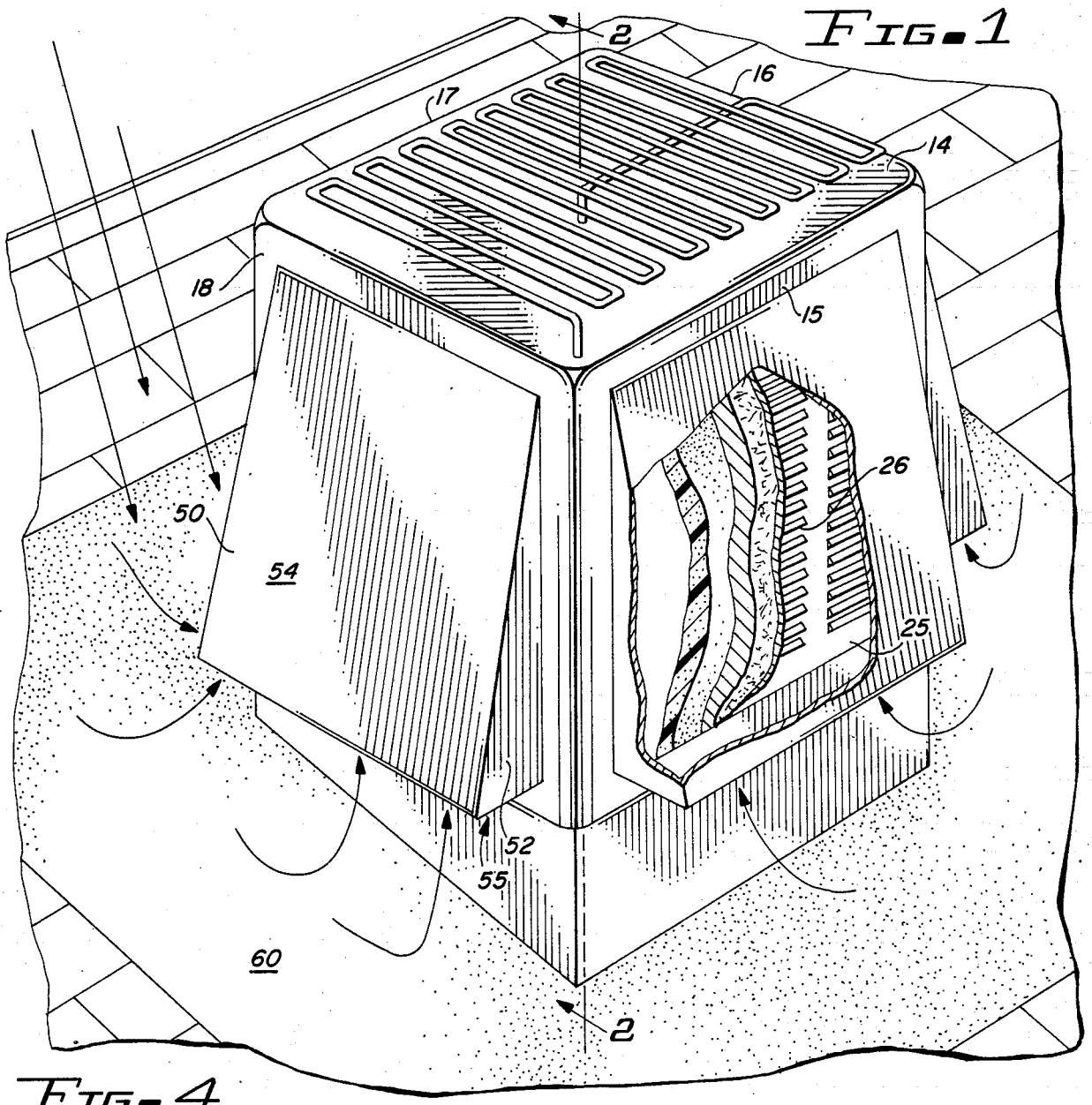
FIG. 1 is a perspective view of a conventional evaporative cooler incorporating the enthalpic cooling and heating feature of the present invention.
Figure 2:
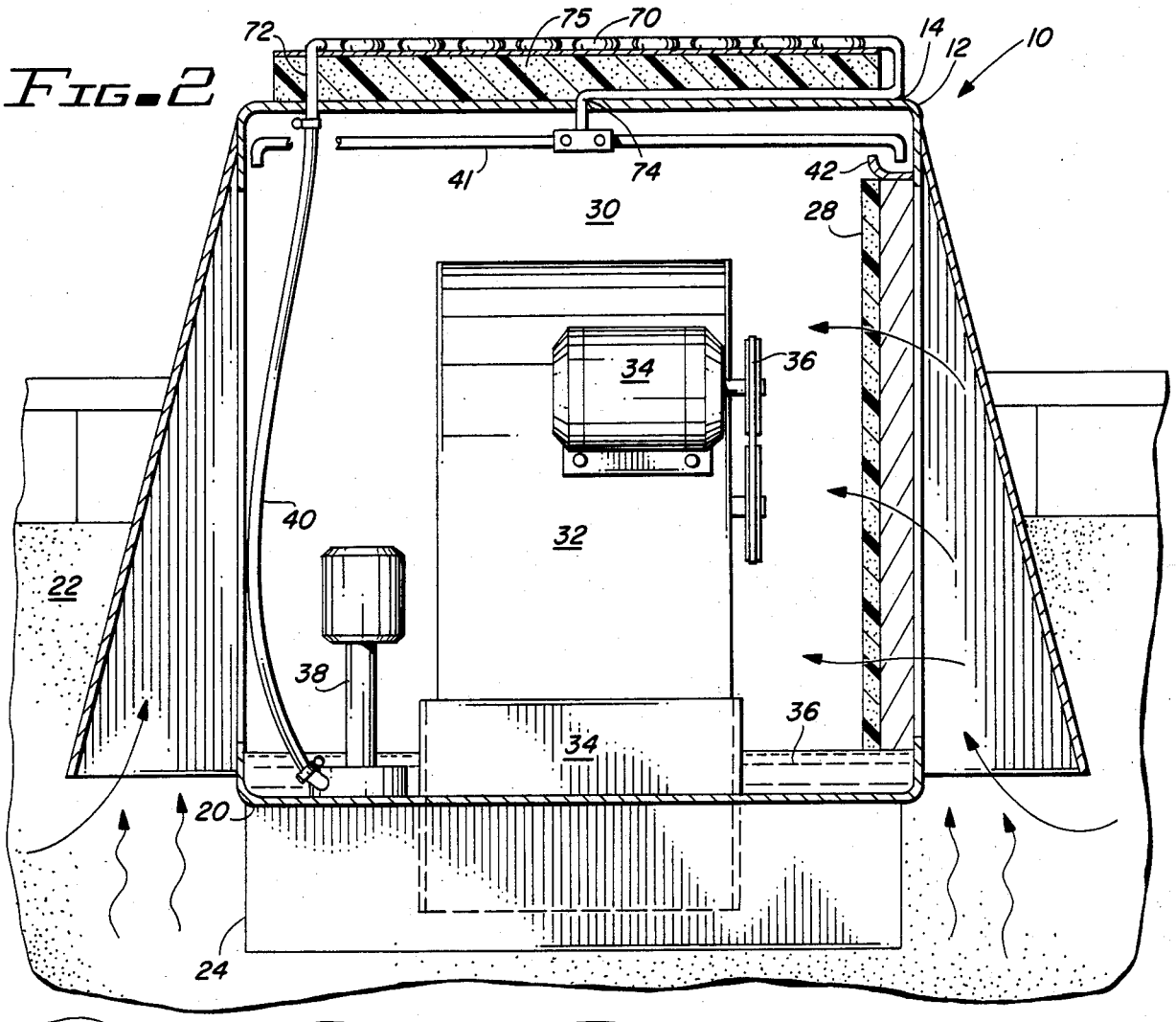
FIG. 2 is a sectional view along lines 2—2 of FIG. 1.
Figure 3:
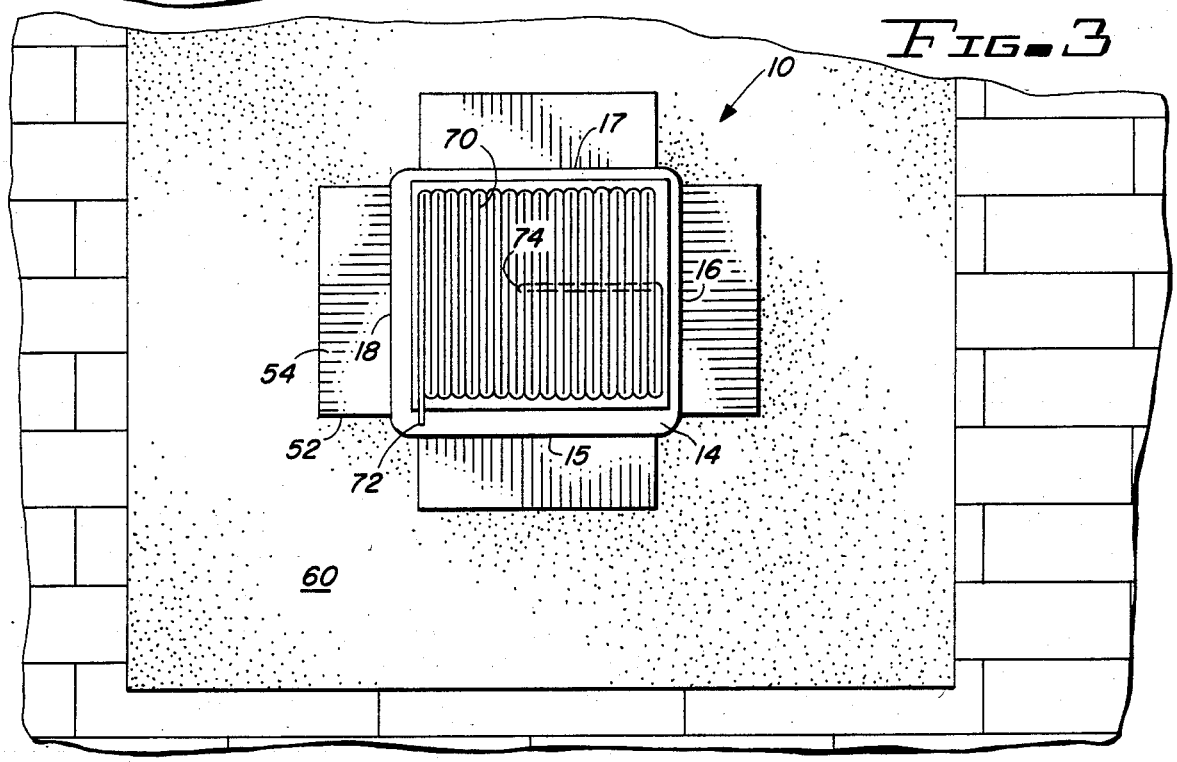
FIG. 3 is a top view of the cooler shown in FIGS. 1 and 2.

Turning now to the drawings, particularly FIGS. 1 to 3, a conventional evaporative cooler is generally designated by the numeral 10. The conventional cooler 10 includes a generally rectangular housing or cabinet 12 having a generally horizontal top 14, vertical sides 15 to 18 and bottom 20. The housing or cabinet may be fabricated from any suitable material as is conventional such as fiberglass, stainless steel, plastic or a suitable galvanized or rust proofed sheet metal to minimize the corrosive effect of moisture. The cooler 10 is shown mounted on a pitched roof 22 on base 24. Each of the sides of the cooler 15 to 18 defines a generally rectangular opening which accomodates a removable panel 25 defining a plurality of air louvers 26. Replaceable wettable pads 28 such as excelsior pads wrapped in large mesh cheese cloth are detachably secured at the inner side of the panels 25. Air moves through the louvers 26 and across the pads 28 to the interior chamber 30 of the cooler housing. An air moving device shown as centrifugal blower 32 driven by motor 34 through belt and pulley arrangement 36 is mounted on interior cabinet for drawing ambient air to the cabinet interior. The air moving device discharges at outlet 34 which delivers cool air to the area to be cooled usually through an appropriate air distribution system. A suitable barometric damper may be inserted at the outlet to prevent conditioned air loss when the system is not operating.

A sump 36 is located in the bottom of the cooler cabinet and maintains a reservoir of water at a predetermined level by a float valve, not shown. A circulating pump 38 delivers water from the sump 36 via line 40 and distribution tubes 41 to channels 42 along the top of the pads at the side of the cabinet. The water delivered to the tops of the pads by the delivery tubes 41 flows under the influence of gravity through the pads and the unevaporated water returns to the sump 36 for recirculation. The foregoing is a description of a conventional cooler which comprises no part of the present invention and is set forth for general background only.

The particular size, shape and type of cooler to which the present invention may be applied may vary considerably. For example, the cooler may be constructed of various materials and may be different shapes such as rectangular, square or event round or have one or more pads which may be any suitable shape.

The improvement of the present invention consists of providing means for preheating the air entering the cooler above ambient and also in some instances providing means for elevating the temperature of the water entering the cooler or circulating through the cooler to speed-up the evaporation rate. As has been pointed out above, conventional evaporative cooler machines are generally considered to be only 60 to 80 percent efficient in reaching the saturation temperature at which maximum cooling is achieved. This saturation efficiency makes conventional evaporative coolers ineffective during times of hot, moist air for example 110 degrees Fahrenheit dry bulb and 80 degrees wet bulb. However, an improvement in saturation efficiency can be obtained by altering the conditions of the air entering the cooler from ambient. By increasing the temperature of the air entering the cooler, a lower wet bulb temperature is produced. For example, if the ambient air temperature is 97.5 degrees Fahrenheit and the wet bulb 70 degrees, at 100 percent saturation efficiency the conventional cooling unit would produce 70 degree Fahrenheit air. However, with the present invention, discharged air temperatures of 68 degrees Fahrenheit and lower were obtained. Using the saturation efficiency equation:

$$\frac{97.5\text{ F.} - 68\text{ F.}}{97.5\text{ F.} - 70\text{ F.}} \times 100 = 107.3\%\ SE$$

The above result appears to be inconsistent with principles of physics upon first inspection. However, upon consideration the result is explained by the fact that when air is heated it expands thereby lowering its water content per unit of volume which results in a lower humidity level and dryer air and a lower possible wet bulb at saturation. Dryer air has a lower wet bulb temperature thereby resulting in an improved saturation efficiency.

To this end, the cooler 10 in the present invention is provided with an intake duct 50 at each of the air intake openings at the sides of the unit. Each of the ducts consist of a pair of generally triangular side panels 52 extending at right angles and arranged adjacent at the opposite sides of the inlet openings. A cover panel 54 extends between the side panels having its upper edge engaging the cooler side so that an inlet 55 is defined at the lower end of the duct to permit air to enter the duct and pass through the louvers 26 and the adjacent pad 28. The duct 54 may be attached to the housing by screws or may be detachably secured by wing nuts or turn lock fasteners. Duct 54 is preferably fabricated from a suitable heat absorbing material such as sheet metal or suitable plastic coated with an absorptive coating such as black paint. Thus air entering at inlet 55 will be heated enthalpically by solar radiation prior to entering the evaporative cooler. Further, duct 50 serves to minimize the effect of wind by bringing the intake closer to the warm mounting surface and preventing temperature dilution once this effect is achieved.

Additional enthalpic heating is obtained by solar absorber pad 60 which is placed on the roof surface 22 in an area adjacent and surrounding the cooler. The absorber pad 60 is shown as a sheet material having heat absorbing characteristics and again may be metal coated with a suitable absorptive coating or may be a material such as black roofing material or black vinyl film. Typically pad 60 would extend at least several feet outwardly from the cooler 10. Because of the configuration of duct 50, air entering the cooler necessarily has to pass in close proximity to the surface of pad 60 which serves to heat the incoming air above free-air ambient temperature due to the effects of solar radiation. This is a passive system and enthalpic heating of the incoming air is achieved without the expenditure of any additional energy costs which results in increased saturation efficiency and colder output air temperature. A translucent or transparent intake tunnel to further pre-heat incoming air may be placed at the duct inlet. As mentioned, the system is optimally a passive system utilizing solar energy although other forms of energy may be used to heat and expand the incoming air if economically feasible.

In addition to heating incoming air, it has been found that elevating the temperature of the water delivered to the evaporative pads also provides a beneficial effect as heating speeds the evaporation rate. To this end, a heat exchanger 70 consisting of a series of coils of tubing 71 such as copper tubing are positioned above the top 12 of the cooler. The coils 71 have an inlet 72 which is connected to water delivery line 40. The outlet 74 from the heat exchanger 70 is connected to the water distribution system 41 which distributes water to channels 42 at the top of the pads 28. In order to prevent the cooled air in interior chamber 30 from being heated due to the effects of coil 70, a suitable layer of insulation 75 is interposed beneath the coils and above the top surface 12 of the cooler.

Figures 5, 6:
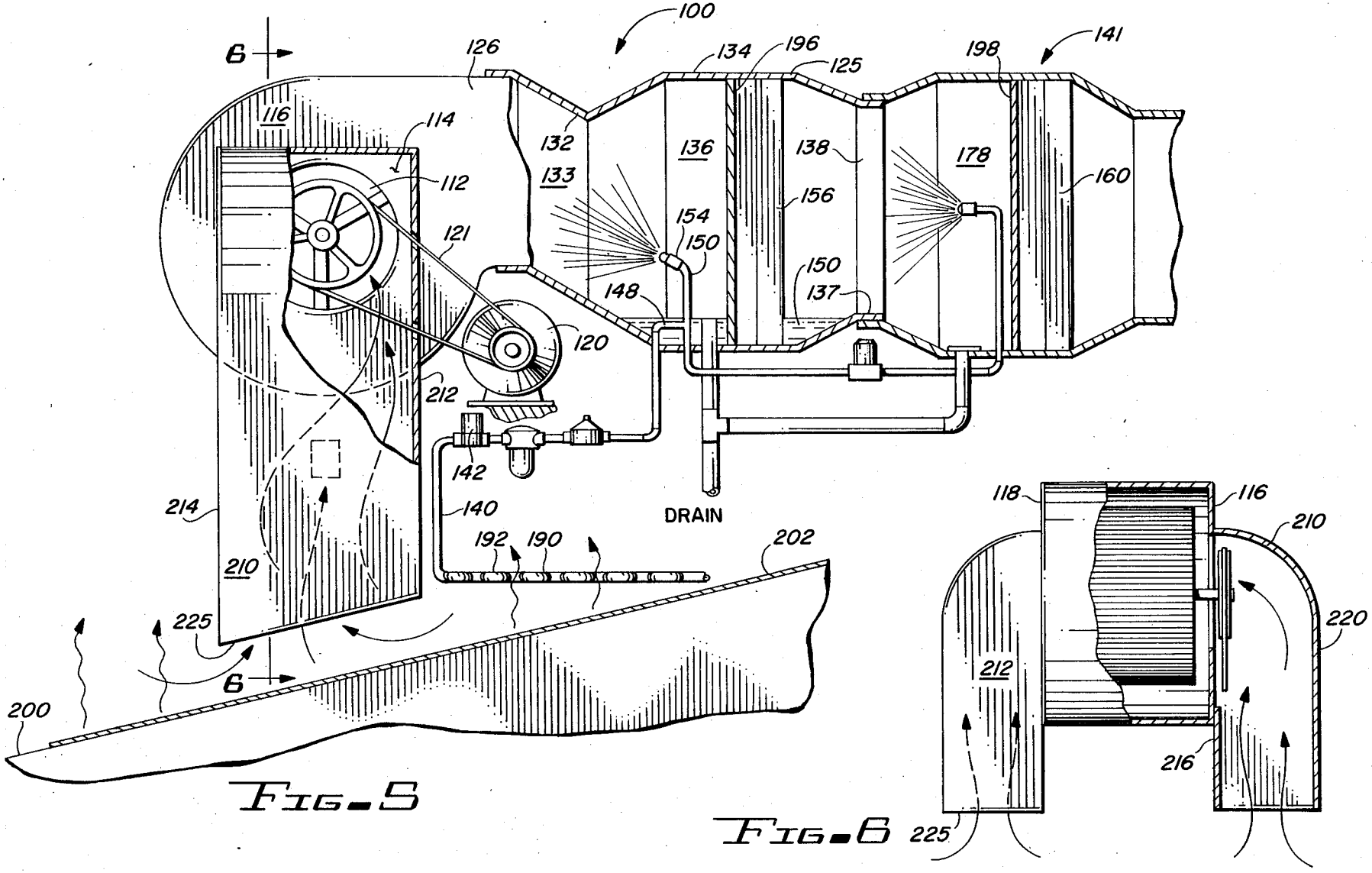
FIG. 5 is an elevational view, partly in section, showing the enthalpic cooling improvement applied to a high efficiency evaporative cooler.
FIG. 6 is a sectional view taken along lines 6—6 of FIG. 5.

The improved enthalpic system of the present invention may be used in conjunction with conventional evaporative coolers and provided as a factory installed feature or can be easily retro-fit in existing installations. The enthalpic cooling feature will benefit all types of evaporative coolers and works particularly well with improved efficiently coolers of the type shown in my prior patent, U.S. Pat. No. 4,308,222. In this regard, FIG. 5 shows the enthalpic feature applied to an improved cooler of this type. Briefly, the improved cooler 100 includes a centrifugal blower 112 or other air moving device having axial inlets 114 formed in the opposite side walls 116 and 118 of the housing. The blower is driven by electric motor 120 through a belt and pulley arrangement 121. Motor 120 is preferably a high efficiency capacitor start, capacitor run AC electric motor such as those manufactured by Westinghouse No. 327-P313, a permanent magnet brush or brushless DC electric motor of the orientated ferrite type permanent magnet field. Typically, such a motor would be rated at ¾ horse-power at 1800 RPM drawing 115 volts at 3 amps. A rectified AC to DC brushless or brush electric motors can also be used to achieve improved electrical efficiency.

An elongated evaporator duct 125 is positioned to receive air under pressure from the blower 112. The configuration of the evaporator duct includes an inlet section 132 connected to air outlet 126 which defines an air inlet passage 133. The air inlet duct section 132 converges and is integral with the main enlarged duct section 134 which defines an expansion chamber 136. The opposite end of the main duct section 134 is reduced to form an outlet air section 137 which defines an air outlet port 138. Subsequent tandemly arranged sections 141 of similar construction may be provided along with a suitable barametric damper as discussed above.

Water supply line 140 is connected to receive water under pressure from a suitable source and includes a valve 142 which may be manually or remotely operable. The water supply line 140 passes through the wall of the enlarged duct section 134 of the evaporator duct 130 and is arranged to form a series of coils 148 disposed adjacent to the bottom of the expansion chamber 136 with the bottom of the expansion chamber serving as a water collection sump 150.

The discharge from coils 148 is connected by conduit 150 to one or more spray nozzles 154 so that water supplied under pressure through line 140 is sprayed in a finely divided mist from the nozzles in a direction which extends angularly upwardly from the nozzle countercurrent to the air movement through the air inlet duct section 132. Accordingly, evap-oration and cooling of the incoming air occurs within the air inlet duct section 132 and because of the angular attitude of the air inlet duct section, migration of moisture for the air moving 112 is inhibited.

An extractor 156 is located in the expansion chamber 136 downstream of spray nozzle 154 to remove free moisture from the moving air by providing a torturous path through which the air must move. The extractor 156, as more fully explained in U.S. Pat. No. 4,308,222, includes a first bank of vanes which are in spaced parallel relationship with one another and are disposed transversely and vertically within expansion chamber. A second plurality of vanes 160 are positioned immediately downstream of the first plurality of vanes. The first extractor is arranged to deflect the moving air toward one side of the evaporator duct 130 and the second extractor is arranged to deflect the air toward the opposite side of the evaporator duct. The moving air will negotiate the torturous path through the extractor 156. Free moisture carried by the moving air will impinge on the extractor vanes and due to the influence of gravity will be collected in the sump 150.

The details of the cooler as set forth above are more fully described in my prior above-referenced U.S. patent and set forth here as background for a better understanding of the improvement constituting the present invention. The basic cooler design of U.S. Pat. No. 4,308,222 forms no part of the present invention.

The features of the improvement include a heat exchanger 190 in waterline 140 consisting of a plurality of coils 192 arranged in serpentine fashion at a location adjacent the cooler where the coils would be subject to full exposure to radiant energy. Cooler 100 may be mounted in any suitable location but generally units of this type are centrally mounted on the roof 200 of the building housing the area to be cooled. Accordingly, heat exchanger 192 is positioned adjacent to the cooler immediately above the roof 200 at a location where a suitable heat absorbing surface 202 such as black vinyl or black roofing material is placed.

At oppositely disposed axial openings 114 the side walls 116 and 118 are each provided with a shroud or housing 210. Each shroud or housing 210 extends from the oppositely disposed axial openings 114 to the unit housing and depends to an elevation just above the roof 200. Each shroud 210 is constructed of a fiberglass, sheet metal or similar material and includes opposite side panels 212 and 214, rear panel 216 and a front panel 220. The upper end of the front panel 220 is curved to form an elbow so that the incoming air is directed into the axial inlet to the fan. The housing 210 may be coated with a heat absorbing coating such as black paint.

The lower end of housing 210 is open at 225 at an elevation just above the roof surface 220. In the area of the opening 225 appropriate heat absorbing material 202 covers the roof. Radiant energy is absorbed by covering 202 which serves to heat the air passing over the covering prior to entering inlet 225 and which causes the air to expand lowering the water content per unit or volume resulting in a lower wet bulb and increased saturization efficiency.

Dust filters 196 and 198 are interposed in the air flow path immediately upstream of the extractors 156 and 160. The filters may be any suitable material such as fiberglass, perforated metal, or excelsior mat and wetted by water spray or by a conduit, not shown, connected to line 140. The filters 196 and 198 provide a slight increase in saturization efficiency but are primarily used to prevent dust, pollen and contaminants from entering into the air distribution system particularly when the system is used for heating purposes. In the cooling cycle these filters also prevent evaporation by-products from entering the treated air space.

The present invention also comprehends use of a conventional evaporative cooler or the improved cooler of U.S. Pat. No. 4,308,222 for providing heat in place of an expensive furnace or heat pump during certain conditions. By incorporating an electric analog control system as shown in FIG. 4, the enthalpic systems of the invention can be used to deliver heat to an area.

Figure 4:
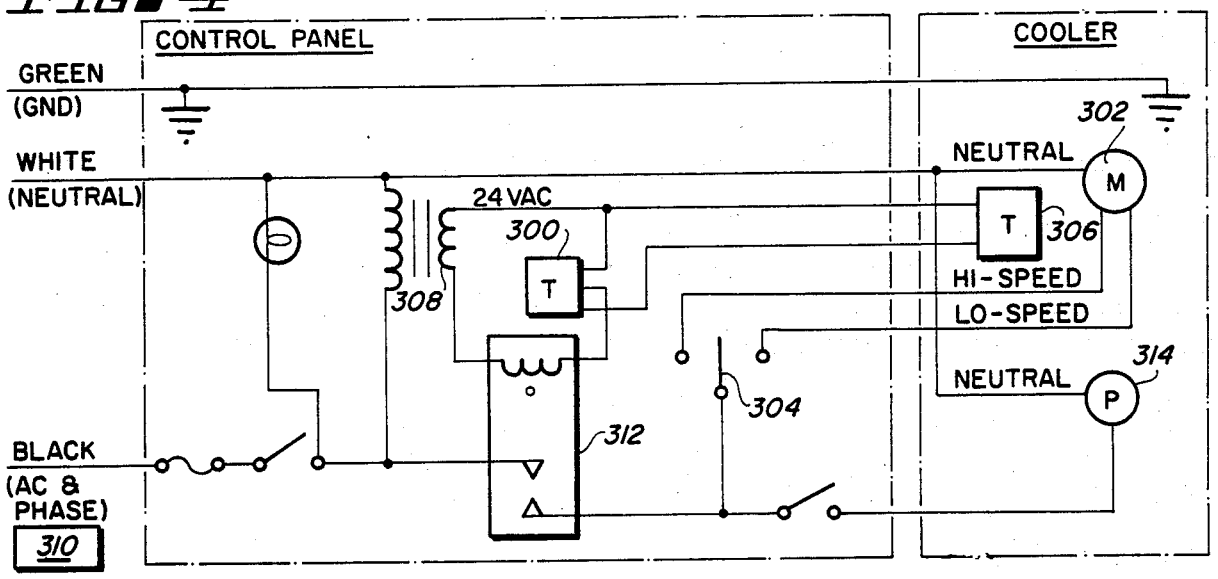
FIG. 4 is a schematic showing the electrical control system for the enthalpic heating and cooling system.

In FIG. 4, thermostat 300 is a low voltage heating and cooling control thermostat which controls the operation of the system and typically is set to make contact at 72 degrees F. Motor 302 is a single, continuously variable or multiple fixed speed motor in the cooler operated by switch 304. Thermostat 306 is a make on temperature rise type, located at an appropriate location on the roof adjacent the unit and is set at typically, 72 degrees F. Line voltage is reduced to 24 V by step-down transformer 308. The heat pump control 310 controls the heat pump, not shown, and typically is a double set back Honeywell T8082A set at 60 degrees F. heat, normal 72 degrees F.

Low voltage power breaker 312 is normally open and controls the line voltage to the motor 302 and to the optional water pump 314 or the water control solenoid at the cooler.

In the heating season when outside air is above 72 degrees F. as determined by thermostat 306 and the thermostat 300 demands heat, a circuit will be completed by thermostats 300 and 306 and motor 302 will turn on to deliver enthalpic heat through the cooler unit. The water spray is in the off position. The system will operate only when ambient air in the vicinity of thermostat 306 is above the 72 degrees F. set point. If the ambient falls below the set point, motor 302 will not be activated and the conventional heat pump is energized by control 310 to supply the necessary heating. When the control thermostat again senses that the ambient has reached a predetermined set point, the heat pump is deactivated. Control 310 includes a relay in the low voltage side which is open in response to thermostat 306 to defeat the heat pump when thermostat 306 is registering above set point. The system will work equally well with a conventional furnace for defeating the furnace operating when sufficient solar heating energy is available.

In order to test the effectiveness of the present system, an improved evaporative cooler built according to U.S. Pat. No. 4,308,222 was installed on the roof of a 2200 square foot livable home in Phoenix, Ariz. Two 34×31×1 inch fiberglass air filters were placed in front of each water separator. Air filters were added to prevent insects, gases, contaminates and dirt from entering the house. Black rolled roofing was placed around the unit to achieve radiant heating of the incoming air to the unit. Further, the water supply to the unit was heated in copper coils exposed radiant thermal energy and placed immediately above the black rolled roofing. The evaporative cooling experiment with the high saturation efficiency modificate was conducted over a period from July 14, 1983 through Sept. 13, 1983. This is a period, when in the Southwest deserts, monsoons are prevalent and periods of high humidity and high temperature are encountered. By using the improvement of the present invention, it was possible to obtain an average saturation efficiency of 119.3% through the 60 day test. Some individual readings were as high as 150% and none were lower than 108%. The daily readings for this period are summarized as follows on chart 1 and 2. A computer was used to reproject the same data at 80% saturation efficiency. For comparison on charts 3 and 4 which follow:

EVAPORATIVE COOLER EXPERIMENT
SUMMER COOLING SEASON OF 1983 WITH HIGH SATURATION EFFICIENCY EXPERIMENT USING COOLER OF PATENT NO. 4,308,222
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| JUL 14 | 104.5 | 78.0 | 32 | 77.0 | 75.0 | NR | 111.321 | 5419 | 5422.0 | 1 | 30.0 | 1860 |
| JUL 15 | 101.0 | 77.0 | 40 | 77.0 | 74.0 | NR | 112.500 | 5419 | 5425.0 | 2 | 30.0 | 1860 |
| JUL 16 | 99.5 | 76.5 | 37 | 77.0 | 72.5 | NR | 117.391 | 5419 | 5428.5 | 3 | 31.7 | 1963 |
| JUL 17 | 101.0 | 77.0 | 35 | 76.0 | 71.0 | NR | 125.000 | 5419 | 5431.0 | 4 | 30.0 | 1860 |
| JUL 18 | 94.0 | 75.0 | 40 | 77.0 | 71.5 | NR | 118.421 | 5419 | 5433.0 | 5 | 28.0 | 1736 |
| JUL 19 | 100.0 | 75.0 | 32 | 77.0 | 73.0 | NR | 108.000 | 5419 | 5435.0 | 6 | 26.7 | 1653 |
| JUL 20 | 92.0 | 74.5 | 45 | 78.0 | 72.5 | NR | 111.429 | 5419 | 5437.0 | 7 | 25.7 | 1594 |
| JUL 21 | 84.0 | 76.5 | 73 | 77.0 | 73.0 | NR | 146.667 | 5419 | 5440.0 | 8 | 26.3 | 1628 |
| JUL 22 | 89.5 | 78.5 | 63 | 78.0 | 75.0 | NR | 131.818 | 5419 | 5441.0 | 9 | 24.4 | 1516 |
| JUL 23 | 99.5 | 82.0 | 49 | 80.0 | 77.0 | NR | 128.571 | 5419 | 5444.0 | 10 | 25.0 | 1550 |
| JUL 24 | 99.0 | 82.5 | 64 | 80.0 | 78.0 | NR | 127.273 | 5419 | 5446.5 | 11 | 25.0 | 1550 |
| JUL 25 | 95.5 | 77.5 | 47 | 78.0 | 74.0 | NR | 119.444 | 5419 | 5450.0 | 12 | 25.8 | 1602 |
| JUL 26 | 100.0 | 75.0 | 32 | 78.0 | 73.0 | NR | 108.000 | 5419 | 5451.0 | 13 | 24.6 | 1526 |
| JUL 27 | 97.0 | 79.0 | 47 | 78.0 | 75.0 | NR | 122.222 | 5419 | 5453.5 | 14 | 24.6 | 1528 |
| JUL 28 | 98.0 | 75.0 | 34 | 78.0 | 73.0 | NR | 108.696 | 5419 | 5456.0 | 15 | 24.7 | 1529 |
| JUL 29 | 100.5 | 78.5 | 40 | 78.0 | 75.0 | NR | 115.909 | 5419 | 5458.5 | 16 | 24.7 | 1531 |
| JUL 30 | 97.0 | 77.0 | 37 | 79.0 | 74.0 | NR | 115.000 | 5419 | 5462.0 | 17 | 25.3 | 1568 |
| JUL 31 | 97.5 | 82.0 | 53 | 79.0 | 77.0 | NR | 132.258 | 5419 | 5465.0 | 18 | 25.6 | 1584 |
| AUG 1 | 100.0 | 80.0 | 44 | 79.0 | 76.5 | NR | 117.500 | 5419 | 5467.5 | 19 | 25.5 | 1583 |
| AUG 2 | 100.5 | 78.0 | 48 | 80.0 | 76.0 | NR | 108.889 | 5419 | 5471.0 | 20 | 26.0 | 1612 |
| AUG 3 | 98.0 | 80.0 | 47 | 80.0 | 77.0 | NR | 116.667 | 5419 | 5473.0 | 21 | 25.7 | 1594 |
| AUG 4 | 92.0 | 76.0 | 37 | 80.0 | 74.0 | NR | 112.500 | 5419 | 5475.5 | 22 | 25.7 | 1592 |
| AUG 5 | 92.5 | 80.0 | 60 | 80.0 | 75.0 | NR | 140.000 | 5419 | 5478.0 | 23 | 25.7 | 1590 |
| AUG 6 | 102.5 | 79.0 | 38 | 80.0 | 76.5 | NR | 110.638 | 5419 | 5481.5 | 24 | 26.0 | 1615 |
| AUG 7 | 93.0 | 79.0 | 55 | 81.0 | 76.0 | NR | 121.429 | 5419 | 5484.0 | 25 | 26.0 | 1612 |
| AUG 8 | 85.0 | 77.0 | 70 | 79.5 | 72.5 | NR | 156.250 | 5419 | 5487.0 | 26 | 26.2 | 1622 |
| AUG 9 | 91.0 | 76.0 | 50 | 77.5 | 74.0 | NR | 113.333 | 5419 | 5491.0 | 27 | 26.7 | 1653 |
| AUG 10 | 88.5 | 76.0 | 59 | 78.0 | 75.0 | NR | 108.000 | 5419 | 5492.5 | 28 | 26.3 | 1628 |
| AUG 11 | 94.5 | 77.0 | 47 | 79.0 | 75.0 | NR | 111.429 | 5419 | 5495.0 | 29 | 26.2 | 1625 |
| AUG 12 | 100.0 | 77.5 | 38 | 78.0 | 74.0 | NR | 115.556 | 5419 | 5497.0 | 30 | 26.0 | 1612 |
| AUG 13 | 97.5 | 79.0 | 45 | 79.0 | 75.0 | NR | 121.622 | 5419 | 5500.0 | 31 | 26.1 | 1620 |
| AUG 14 | 98.0 | 80.0 | 46 | 80.0 | 77.5 | NR | 113.889 | 5419 | 5501.5 | 32 | 25.8 | 1598 |
| AUG 15 | 94.5 | 80.0 | 54 | 80.0 | 77.5 | NR | 117.241 | 5419 | 5504.0 | 33 | 25.8 | 1597 |
| AUG 16 | 72.0 | 71.0 | 95 | 78.0 | 71.0 | NR | 100.000 | 5419 | 5506.5 | 34 | 25.7 | 1596 |
| AUG 17 | 74.5 | 72.5 | 90 | 76.0 | 71.5 | NR | 150.000 | 5419 | 5508.5 | 35 | 25.6 | 1585 |
| AUG 18 | 86.5 | 73.0 | 55 | 76.0 | 72.0 | NR | 107.407 | 5419 | 5511.0 | 36 | 25.6 | 1584 |
| AUG 19 | 88.5 | 75.0 | 54 | 76.0 | 74.0 | NR | 107.407 | 5419 | 5512.5 | 37 | 25.3 | 1567 |
| AUG 20 | 90.0 | 76.0 | 54 | 77.0 | 75.0 | NR | 107.143 | 5419 | 5515.5 | 38 | 25.4 | 1574 |
| AUG 21 | 90.5 | 75.0 | 49 | 77.5 | 73.0 | NR | 112.903 | 5419 | 5518.5 | 39 | 25.5 | 1582 |
| AUG 22 | 90.0 | 73.0 | 45 | 78.0 | 72.0 | NR | 105.882 | 5419 | 5522.0 | 40 | 25.8 | 1597 |
| AUG 23 | 93.0 | 77.5 | 50 | 78.0 | 75.0 | NR | 116.129 | 5419 | 5524.0 | 41 | 25.6 | 1588 |
| AUG 24 | 90.5 | 77.5 | 57 | 78.0 | 75.0 | NR | 119.231 | 5419 | 5525.5 | 42 | 25.4 | 1572 |
| AUG 25 | 99.5 | 75.0 | 32 | 78.0 | 73.0 | NR | 108.163 | 5419 | 5527.5 | 43 | 25.2 | 1564 |
| AUG 26 | 98.5 | 78.5 | 42 | 79.5 | 77.0 | NR | 107.500 | 5419 | 5530.5 | 44 | 25.3 | 1571 |
| AUG 27 | 97.0 | 79.5 | 47 | 78.0 | 77.0 | NR | 114.286 | 5419 | 5532.5 | 45 | 25.2 | 1564 |
| AUG 28 | 94.5 | 80.0 | 54 | 78.5 | 76.0 | NR | 127.586 | 5419 | 5535.0 | 46 | 25.2 | 1563 |

-continued

EVAPORATIVE COOLER EXPERIMENT
SUMMER COOLING SEASON OF 1983 WITH HIGH SATURATION EFFICIENCY EXPERIMENT USING COOLER OF PATENT NO. 4,308,222
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| AUG 29 | 93.5 | 78.0 | 50 | 79.0 | 75.0 | NR | 119.355 | 5419 | 5538.5 | 47 | 25.4 | 1576 |
| AUG 30 | 95.0 | 79.0 | 50 | 79.5 | 77.0 | NR | 112.500 | 5419 | 5542.0 | 48 | 25.6 | 1589 |
| AUG 31 | 98.5 | 80.0 | 46 | 80.5 | 77.5 | NR | 113.514 | 5419 | 5545.0 | 49 | 25.7 | 1594 |
| SEP 1 | 98.5 | 80.5 | 47 | 81.0 | 77.5 | NR | 116.667 | 5419 | 5550.0 | 50 | 26.2 | 1624 |
| SEP 2 | 101.5 | 82.0 | 47 | 81.0 | 79.0 | NR | 115.385 | 5419 | 5552.5 | 51 | 26.2 | 1623 |
| SEP 3 | 96.5 | 80.0 | 49 | 81.0 | 76.0 | NR | 124.242 | 5419 | 5555.5 | 52 | 26.3 | 1628 |
| SEP 4 | 95.0 | 80.0 | 53 | 79.0 | 76.0 | NR | 126.667 | 5419 | 5558.5 | 53 | 26.3 | 1632 |
| SEP 5 | 96.5 | 81.0 | 52 | 80.5 | 77.5 | NR | 122.581 | 5419 | 5562.0 | 54 | 26.5 | 1642 |
| SEP 6 | 95.0 | 83.5 | 63 | 80.5 | 78.0 | NR | 147.826 | 5419 | 5566.0 | 55 | 26.7 | 1657 |
| SEP 7 | 91.0 | 80.0 | 64 | 79.0 | 75.0 | NR | 145.455 | 5419 | 5570.0 | 56 | 27.0 | 1672 |
| SEP 8 | 96.5 | 80.0 | 50 | 79.0 | 77.0 | NR | 118.182 | 5419 | 5573.0 | 57 | 27.0 | 1675 |
| SEP 9 | 98.5 | 80.0 | 47 | 79.0 | 77.0 | NR | 116.216 | 5419 | 5577.0 | 58 | 27.2 | 1689 |
| SEP 10 | 90.0 | 80.0 | 66 | 79.0 | 76.0 | NR | 140.000 | 5419 | 5581.0 | 59 | 27.5 | 1702 |
| SEP 11 | NR | NR | NR | NR | NR | NR | NR | 5419 | 5585.0 | 60 | 27.7 | 1715 |
| SEP 12 | NR | NR | NR | NR | NR | NR | NR | 5419 | 5589.0 | 61 | 27.9 | 1728 |
| SEP 13 | NR | NR | NR | NR | NR | NR | NR | 5419 | 5593.0 | 62 | 28.1 | 1740 |
| AVERAGE | 94.71 | 77.9 | 50 | 78.6 | 75.0 | | 119.442 | | ACTUAL | | | 1740 |

EVAPORATIVE COOLER 1983 (CONVENTIONAL)
SUMMER COOLING SEASON WITH CONVENTIONAL 80% SATURATION EFFICIENCY COOLER WITH HIGH EFFICIENCY ELECTRIC MOTOR
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| JUL 14 | 104.5 | 78.0 | 32 | 86.9 | 83.3 | NR | 80.000 | 5419 | 5422.0 | 1 | 30.0 | 1860 |
| JUL 15 | 101.0 | 77.0 | 40 | 85.4 | 81.8 | NR | 80.000 | 5419 | 5425.0 | 2 | 30.0 | 1860 |
| JUL 16 | 99.5 | 76.5 | 37 | 84.7 | 81.1 | NR | 80.000 | 5419 | 5428.5 | 3 | 31.7 | 1963 |
| JUL 17 | 101.0 | 77.0 | 35 | 85.4 | 81.8 | NR | 80.000 | 5419 | 5431.0 | 4 | 30.0 | 1860 |
| JUL 18 | 94.0 | 75.0 | 40 | 82.4 | 78.8 | NR | 80.000 | 5419 | 5433.0 | 5 | 28.0 | 1736 |
| JUL 19 | 100.0 | 75.0 | 32 | 83.6 | 80.0 | NR | 80.000 | 5419 | 5435.0 | 6 | 26.7 | 1653 |
| JUL 20 | 92.0 | 74.5 | 45 | 81.6 | 78.0 | NR | 80.000 | 5419 | 5437.0 | 7 | 25.7 | 1594 |
| JUL 21 | 84.0 | 76.5 | 73 | 81.6 | 78.0 | NR | 80.000 | 5419 | 5440.0 | 8 | 26.3 | 1628 |
| JUL 22 | 89.5 | 78.5 | 63 | 84.3 | 80.7 | NR | 80.000 | 5419 | 5441.0 | 9 | 24.4 | 1516 |
| JUL 23 | 99.5 | 82.0 | 49 | 89.1 | 85.5 | NR | 80.000 | 5419 | 5444.0 | 10 | 25.0 | 1550 |
| JUL 24 | 99.0 | 82.5 | 64 | 89.4 | 85.8 | NR | 80.000 | 5419 | 5446.5 | 11 | 25.0 | 1550 |
| JUL 25 | 95.5 | 77.5 | 47 | 84.7 | 81.1 | NR | 80.000 | 5419 | 5450.0 | 12 | 25.8 | 1602 |
| JUL 26 | 100.0 | 75.0 | 32 | 83.6 | 80.0 | NR | 80.000 | 5419 | 5451.0 | 13 | 24.6 | 1526 |
| JUL 27 | 97.0 | 79.0 | 47 | 86.2 | 82.6 | NR | 80.000 | 5419 | 5453.5 | 14 | 24.6 | 1528 |
| JUL 28 | 98.0 | 75.0 | 34 | 83.2 | 79.6 | NR | 80.000 | 5419 | 5456.0 | 15 | 24.7 | 1529 |
| JUL 29 | 100.5 | 78.5 | 40 | 86.5 | 82.9 | NR | 80.000 | 5419 | 5458.5 | 16 | 24.7 | 1531 |
| JUL 30 | 97.0 | 77.0 | 37 | 84.6 | 81.0 | NR | 80.000 | 5419 | 5462.0 | 17 | 25.3 | 1568 |
| JUL 31 | 97.5 | 82.0 | 53 | 88.7 | 85.1 | NR | 80.000 | 5419 | 5465.0 | 18 | 25.6 | 1584 |
| AUG 1 | 100.0 | 80.0 | 44 | 87.6 | 84.0 | NR | 80.000 | 5419 | 5467.5 | 19 | 25.5 | 1583 |
| AUG 2 | 100.5 | 78.0 | 48 | 86.1 | 82.5 | NR | 80.000 | 5419 | 5471.0 | 20 | 26.0 | 1612 |
| AUG 3 | 98.0 | 80.0 | 47 | 87.2 | 83.6 | NR | 80.000 | 5419 | 5473.0 | 21 | 25.7 | 1594 |
| AUG 4 | 92.0 | 76.0 | 37 | 82.8 | 79.2 | NR | 80.000 | 5419 | 5475.5 | 22 | 25.7 | 1592 |
| AUG 5 | 92.5 | 80.0 | 60 | 86.1 | 82.5 | NR | 80.000 | 5419 | 5478.0 | 23 | 25.7 | 1590 |
| AUG 6 | 102.5 | 79.0 | 38 | 87.3 | 83.7 | NR | 80.000 | 5419 | 5481.5 | 24 | 26.0 | 1615 |
| AUG 7 | 93.0 | 79.0 | 55 | 85.4 | 81.8 | NR | 80.000 | 5419 | 5484.0 | 25 | 26.0 | 1612 |
| AUG 8 | 85.0 | 77.0 | 70 | 82.2 | 78.6 | NR | 80.000 | 5419 | 5487.0 | 26 | 26.2 | 1622 |
| AUG 9 | 91.0 | 76.0 | 50 | 82.6 | 79.0 | NR | 80.000 | 5419 | 5491.0 | 27 | 26.7 | 1653 |
| AUG 10 | 88.5 | 76.0 | 59 | 82.1 | 78.5 | NR | 80.000 | 5419 | 5492.5 | 28 | 26.3 | 1628 |
| AUG 11 | 94.5 | 77.0 | 47 | 84.1 | 80.5 | NR | 80.000 | 5419 | 5495.0 | 29 | 26.2 | 1625 |
| AUG 12 | 100.0 | 77.5 | 38 | 85.6 | 82.0 | NR | 80.000 | 5419 | 5497.0 | 30 | 26.0 | 1612 |
| AUG 13 | 97.5 | 79.0 | 45 | 86.3 | 82.7 | NR | 80.000 | 5419 | 5500.0 | 31 | 26.1 | 1620 |
| AUG 14 | 98.0 | 80.0 | 46 | 87.2 | 83.6 | NR | 80.000 | 5419 | 5501.5 | 32 | 25.8 | 1598 |
| AUG 15 | 94.5 | 80.0 | 54 | 86.5 | 82.9 | NR | 80.000 | 5419 | 5504.0 | 33 | 25.8 | 1597 |
| AUG 16 | 72.0 | 71.0 | 95 | 74.8 | 71.2 | NR | 80.000 | 5419 | 5506.5 | 34 | 25.7 | 1596 |
| AUG 17 | 74.5 | 72.5 | 90 | 76.5 | 72.9 | NR | 80.000 | 5419 | 5508.5 | 35 | 25.6 | 1585 |
| AUG 18 | 86.5 | 73.0 | 55 | 79.3 | 75.7 | NR | 80.000 | 5419 | 5511.0 | 36 | 25.6 | 1584 |
| AUG 19 | 88.5 | 75.0 | 54 | 81.3 | 77.7 | NR | 80.000 | 5419 | 5512.5 | 37 | 25.3 | 1567 |
| AUG 20 | 90.0 | 76.0 | 54 | 82.4 | 78.8 | NR | 80.000 | 5419 | 5515.5 | 38 | 25.4 | 1574 |
| AUG 21 | 90.5 | 75.0 | 49 | 81.7 | 78.1 | NR | 80.000 | 5419 | 5518.5 | 39 | 25.5 | 1582 |
| AUG 22 | 90.0 | 73.0 | 45 | 80.0 | 76.4 | NR | 80.000 | 5419 | 5522.0 | 40 | 25.8 | 1597 |
| AUG 23 | 93.0 | 77.5 | 50 | 84.2 | 80.6 | NR | 80.000 | 5419 | 5524.0 | 41 | 25.6 | 1588 |
| AUG 24 | 90.5 | 77.5 | 57 | 83.7 | 80.1 | NR | 80.000 | 5419 | 5525.5 | 42 | 25.4 | 1572 |
| AUG 25 | 99.5 | 75.0 | 32 | 83.5 | 79.9 | NR | 80.000 | 5419 | 5527.5 | 43 | 25.2 | 1564 |
| AUG 26 | 98.5 | 78.5 | 42 | 86.1 | 82.5 | NR | 80.000 | 5419 | 5530.5 | 44 | 25.3 | 1571 |
| AUG 27 | 97.0 | 79.5 | 47 | 86.6 | 83.0 | NR | 80.000 | 5419 | 5532.3 | 45 | 25.2 | 1564 |
| AUG 28 | 94.5 | 80.0 | 54 | 86.5 | 82.9 | NR | 80.000 | 5419 | 5535.0 | 46 | 25.2 | 1563 |

-continued

EVAPORATIVE COOLER 1983 (CONVENTIONAL)
SUMMER COOLING SEASON WITH CONVENTIONAL 80% SATURATION EFFICIENCY COOLER WITH HIGH EFFICIENCY ELECTRIC MOTOR
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| AUG 29 | 93.5 | 78.0 | 50 | 84.7 | 81.1 | NR | 80.000 | 5419 | 5538.5 | 47 | 25.4 | 1576 |
| AUG 30 | 95.0 | 79.0 | 50 | 85.8 | 82.2 | NR | 80.000 | 5419 | 5542.0 | 48 | 25.6 | 1589 |
| AUG 31 | 98.5 | 80.0 | 46 | 87.3 | 83.7 | NR | 80.000 | 5419 | 5545.0 | 49 | 25.7 | 1594 |
| SEP 1 | 98.5 | 80.5 | 47 | 87.7 | 84.1 | NR | 80.000 | 5419 | 5550.0 | 50 | 26.2 | 1624 |
| SEP 2 | 101.5 | 82.0 | 47 | 89.5 | 85.9 | NR | 80.000 | 5419 | 5552.5 | 51 | 26.2 | 1623 |
| SEP 3 | 96.5 | 80.0 | 49 | 86.9 | 83.3 | NR | 80.000 | 5419 | 5555.5 | 52 | 26.3 | 1628 |
| SEP 4 | 95.0 | 80.0 | 53 | 86.6 | 83.0 | NR | 80.000 | 5419 | 5558.5 | 53 | 26.3 | 1632 |
| SEP 5 | 96.5 | 81.0 | 52 | 87.7 | 84.1 | NR | 80.000 | 5419 | 5562.0 | 54 | 26.5 | 1642 |
| SEP 6 | 95.0 | 83.5 | 63 | 89.4 | 85.8 | NR | 80.000 | 5419 | 5566.0 | 55 | 26.7 | 1657 |
| SEP 7 | 91.0 | 80.0 | 64 | 85.8 | 82.2 | NR | 80.000 | 5419 | 5570.0 | 56 | 27.0 | 1672 |
| SEP 8 | 96.5 | 80.0 | 50 | 86.9 | 83.3 | NR | 80.000 | 5419 | 5573.0 | 57 | 27.0 | 1675 |
| SEP 9 | 98.5 | 80.0 | 47 | 87.3 | 83.7 | NR | 80.000 | 5419 | 5577.0 | 58 | 27.2 | 1689 |
| SEP 10 | 90.0 | 80.0 | 66 | 85.6 | 82.0 | NR | 80.000 | 5419 | 5581.0 | 59 | 27.5 | 1702 |
| SEP 11 | NR | NR | NR | NR | NR | NR | NR | 5419 | 5585 | 60 | 27.7 | 1715 |
| SEP 12 | NR | NR | NR | NR | NR | NR | NR | 5419 | 5589 | 61 | 27.9 | 1728 |
| SEP 13 | NR | NR | NR | NR | NR | NR | NR | 5419 | 5593 | 62 | 28.1 | 1740 |
| AVERAGE | 94.71 | 77.9 | 50 | 84.9 | 81.3 | | 80.000 | | ACTUAL | | | 1740 |

As can be seen from the foregoing data, the result was the air temperature in the cooled air space in the house was 6.3 degrees lower using this invention than the temperature achieved by a conventional 80% saturation efficiency cooler.

Figure 7:
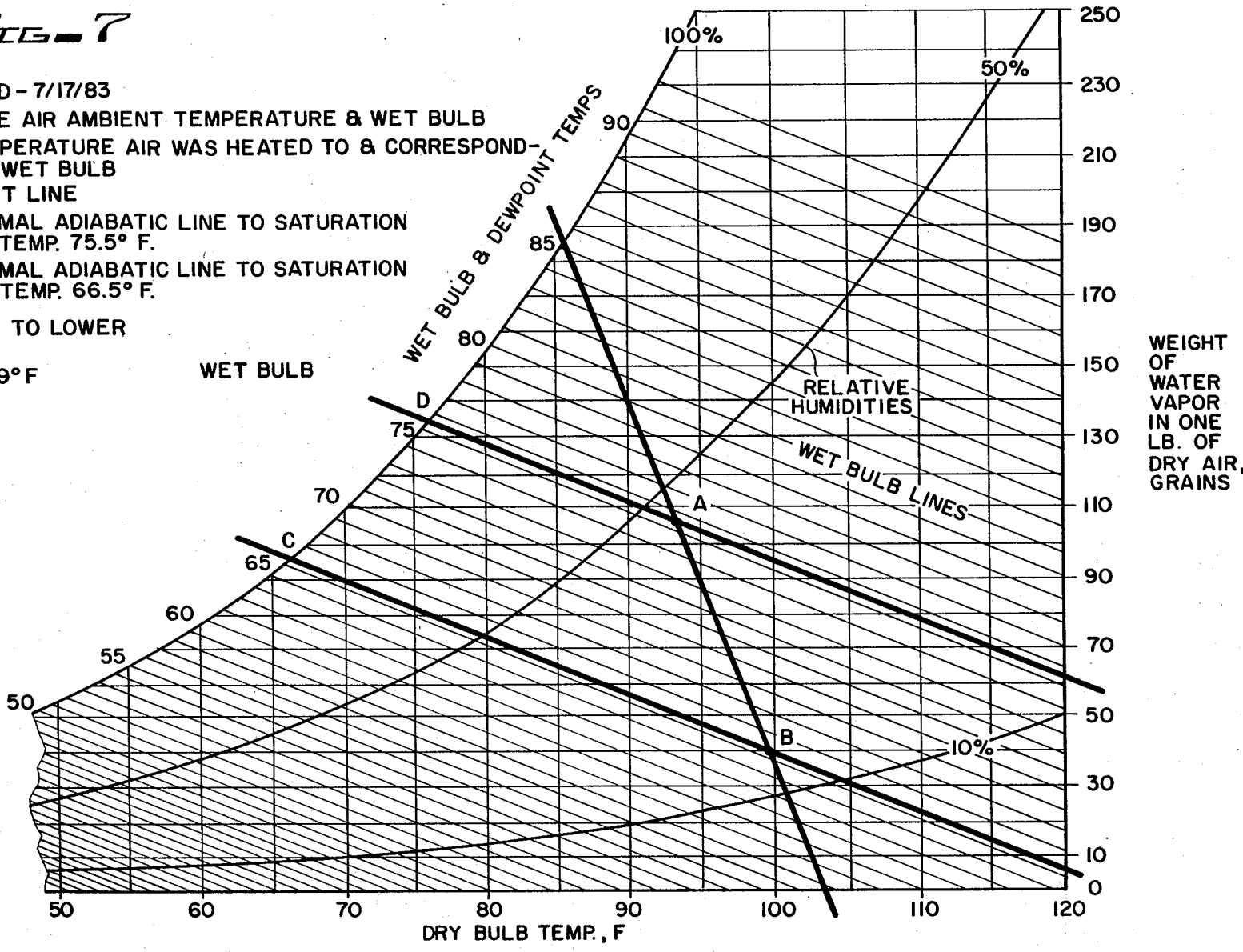
FIG. 7 is a psychrometric chart showing the shift which occurs to lower the saturation temperature by raising temperature of the free air with the present invention.

The chart of FIG. 7 is a psychrometric chart showing ambient air temperature, cooler air intake temperature as a result of enthalpic heating and the resulting improvement from data taken July 17, 1983. Point A is the free air ambient temperature and wet bulb temperature. Point B is the temperature to which the air was heated using the invention and the corresponding wet bulb. The improvement or shift lowering the wet bulb is 90° F. resulting in substantial increase in efficiency and lowered air temperature.

The enthalpic heating system was tested during the winter of 1981–1982 with the system again used in conjunction with a cooler according to U.S. Pat. No. 4,308,222 and modified as shown in FIGS. 5 and 6. For the next months of the heating season, electrical power usage in KWH and dollars were compared to the previous same six months in 1980–1981 in which a conventional heat pump was used to heat. Electrical power consumption for heating the house was reduced 48% and the temperature was maintained at a comfortable 72 degrees even though the winter for the test period was about 15% colder in degree days than the year 1981 which served as the comparison year. Had the winters been comparable, approximately 60% savings would have been realized.

It will be obvious to those skilled in the art to make various changes, modifications and alterations to the invention described herein. To the extent that these changes and modifications do not depart from the scope of the appended claims, they are intended to be encompassed therein.

I claim:

1. An improved enthalpic cooling apparatus for use with an evaporative cooling device which includes a housing having an intake open to ambient air to be treated and a discharge for treated air, air delivery means having a motor for inducing an airflow path from the said intake to discharge, and evaporative treatment means including water treatment means in said airflow path for effecting evaporative cooling, said improved apparatus comprising a thermally absorbant material for solar heating and expanding the air introduced at said intake above the temperature of the said ambient air thereby decreasing the wet bulb temperature of air adjacent said thermally absorbent material and inlet duct means communicating the heated and expanded air from proximate said thermally absorbent material to said intake.

2. The apparatus of claim 1 wherein said solar enthalpic heating means comprises heat absorptive material adjacent the said inlet housing means.

3. The apparatus of claim 1 wherein said inlet housing means comprises duct means associated with said intake, said duct means communicating with ambient air adjacent said solar enthalpic air heating means.

4. The apparatus of claim 3 wherein said duct means defines a solar heating passageway, said passageway having a surface adapted to pass at least short wave solar radiation thereby heating air passing therethrough.

5. The apparatus of claim 3 wherein said duct means is coated with a heat absorptive material.

6. The apparatus of claim 1 further including heat exchanger means interposed to heat said water supply prior to evaporative air treatments, said heat exchanger positioned to receive solar energy.

7. The apparatus of claim 1 further including barometric damper means associated with said discharge.

8. The apparatus of claim 1 wherein said evaporative treatment means comprises at least one wettable evaporative pad in the airflow path.

9. The apparatus of claim 1 wherein said evaporative treatment means comprises at least one evaporator duct in the airflow path including spray means for spraying water into the airflow path countercurrent to the airflow direction.

10. The apparatus of claim 1 wherein said motor is a high efficiency, capacitor start, capacitor run AC electric motor.

11. The apparatus of claim 1 wherein said motor is a permanent magnet DC electric motor of the orientated ferrite type.

12. The improved enthalpic cooling apparatus of claim 1 further including an enthalpic heating system including a heating unit having a thermostatic control, said heating system comprising:

(a) thermostatic control means having a first control position in the cooling mode and a second control position in the heating mode;

(b) air delivery means having an inlet communicating with ambient air;

(c) temperature sensing means for sensing the ambient air temperature;

(d) low voltage power breaker in the heating unit circuit whereby the low voltage thermostat will actuate the air delivery means when the temperature sensing means detects an ambient temperature above a pre-determined set point to draw ambient air for heating and will when the ambient temperature is below set point allow the heating unit to operate.

13. The system of claim 12 wherein said heating unit is a heat pump.

14. The system of claim 12 wherein said air delivery means comprises an evaporative cooler and further including circuit means to deactuate the water supply during the heating cycle.

15. The system of claim 12 wherein said heating unit is a furnace.

16. A method of enthalpic cooling ambient air having an ambient temperature introduction into a space to be cooled which comprises:

(a) heating a portion of the ambient air to a predetermined temperature above the said ambient temperature by exposing the ambient air to solar heating means thereby creating a zone of heated air having an expanded volume and lowered wet bulb temperature as compared with ambient air;

(b) withdrawing and subjecting air from said zone to evaporative treatment to adiabatically effect evaporative cooling toward saturation thereby achieving a lower dry bulb temperature as compared to the dry bulb thermodynamically possible with said ambient air; and (c) delivering the evaporatively cooled air to said space.

* * * * *